United States Patent [19]

Richison

[11] Patent Number: 4,898,154

[45] Date of Patent: Feb. 6, 1990

[54] ADJUSTABLE FITTING FOR FIREPLACE INSERT FLUE CONNECTION

[75] Inventor: David E. Richison, Kettering, Ohio

[73] Assignee: Richison Industries Incorporated, Kettering, Ohio

[21] Appl. No.: 252,121

[22] Filed: Oct. 3, 1988

[51] Int. Cl.[4] ..... F24B 7/00; F23J 13/04

[52] U.S. Cl. ..... 126/500; 126/307 R

[58] Field of Search ..... 126/500, 536, 538, 307 R, 126/315

[56] References Cited

U.S. PATENT DOCUMENTS

| | | | |
|---|---|---|---|
| 1,031,378 | 7/1912 | Roller . | |
| 3,308,808 | 3/1967 | Malafouris | 126/314 |
| 3,574,983 | 4/1971 | Kreider | 126/307 R |
| 4,207,862 | 6/1980 | Meyer | 126/137 |
| 4,306,491 | 12/1981 | Reardon, Jr. | 126/500 |
| 4,424,794 | 1/1984 | Page | 126/500 |
| 4,584,986 | 4/1986 | Cannata | 126/500 |
| 4,683,623 | 8/1987 | Cannata | 126/123 |

FOREIGN PATENT DOCUMENTS

| | | | |
|---|---|---|---|
| 718224 | 11/1954 | United Kingdom | 126/307 R |

OTHER PUBLICATIONS

"Vermont Castings Fireplace Stove Adaptor", Randolph, Vermont 05060, 4/13/1981.

*Primary Examiner*—Margaret A. Focarino
*Assistant Examiner*—Denise L. Ferensic
*Attorney, Agent, or Firm*—Killworth, Gottman, Hagan & Schaeff

[57] ABSTRACT

An adjustable fitting for directly connecting a wood burning insert for a masonry fireplace to a vent pipe positioned within a flue liner of the fireplace chimney is made up of an insert connector having first and second legs which are substantially perpendicular to one another. Thr first leg of the insert connector is vertically oriented when the fitting is in place and is sized to engage a flue gas outlet of a wide variety of wood burning inserts. A vent pipe connector completes the adjustable fitting and also has first and second legs which are substantially perpendicular to one another. The first leg of the vent pipe connector is vertically oriented when the fitting is in use and is sized to engage a lowermost end of the vent pipe. The second legs of the insert connector and the vent pipe connector are formed such that they can be telescopically interfitted to one another to adjust the spacing between the first legs of the connectors and thereby adapt the fitting to a large variety of inserts and fireplaces.

7 Claims, 3 Drawing Sheets

ADJUSTABLE FITTING FOR FIREPLACE INSERT FLUE CONNECTION

BACKGROUND OF THE INVENTION

The present invention relates generally to the installation of a wood burning stove or "insert" into a masonry fireplace and, more particularly, to an adjustable fitting for positively connecting such an insert to a vent pipe positioned within the flue liner of a fireplace.

Wood burning fireplaces have been a common heat source for centuries and provide an inner warmth and satisfaction above and beyond any heat which is provided by the fire. Accordingly, one or more fireplaces can be found in many homes. Unfortunately, in spite of the pleasure of a wood fire, the use of a fireplace actually withdraws heated air from a modern house and hence, adds to the load placed on a central heating system resulting in higher fuel costs.

Since fuel costs have increased in the recent past and probably will continue to increase, more efficient ways of enjoying the "warmth" of a wood fire have been pursued. Heating efficiency of wood burning can be greatly increased by using a stand alone wood stove instead of a fireplace. However, such wood stoves occupy space within a home and to be safe require fireproofing of the areas surrounding the stove, for example by brickwork, or other fireproof material, such that their installation not only robs otherwise useable space from the home but also can be expensive. Accordingly, more efficient ways of operating a fireplace have been sought and resulted in the fireplace insert which is a wood stove which is fitted within or "inserted" into a fireplace opening.

Oftentimes inserts are installed by simply removing a fireplace damper and fitting the insert into the fireplace such that flue gases from the insert enter a smoke chamber of the fireplace and exit through a flue liner of the fireplace chimney. Such simple installations unfortunately reduce the effectiveness of the insert since there is no true seal between the fireplace opening and the surrounding edges of the insert and heated air from the house is still drawn up through the chimney. More importantly, a masonry fireplace has excessive internal surface area and many times the air flow capacity that is required by an insert such that the flue gases are quickly cooled allowing them to condense and deposit creosote within the fireplace and along the interior surfaces of the flue liner of the chimney. While some creosote deposits can be removed by regular cleaning performed by a competent chimney sweep, others can only be removed by heat. In any event, creosote deposits create a fire hazard within the fireplace and flue liner.

In an effort to overcome continuing heat loss and fire hazards, "positive connection" systems have been developed wherein a conduit is extended from the insert through the throat area of a removed damper of a masonry fireplace and sealed at the damper by means of insulation or otherwise. Positive connection systems route the flue gases substantially through the smoke chamber and more directly into the flue liner of the masonry fireplace chimney. Positive connection systems may in fact substantially seal the conduit or pipe coming from the insert to the bottom of the flue liner of a chimney, for example, as disclosed in U.S. Pat. No. 4,683,623. While positive connection systems substantially eliminate the loss of heated air from inside a house, the surface area and air flow capacity of the flue liner of a masonry fireplace still result in excessive production of creosote such that the fire hazard of the insert remains.

The best available solution to the dual problems of the installation of a wood burning insert into a masonry fireplace will be referred to herein as a "direct connection" system. In a direct connection system, an appropriately sized flue pipe is inserted through the flue liner of the fireplace chimney to thereby reduce its surface area and air flow capacity to that required by the insert. The flue pipe is positively sealed to the insert and also sealed at the top of the fireplace chimney by means of insulation and possibly masonry fill or otherwise such that any heated air from the inside of the house as well as heat transferred through the flue pipe tends to increase the stack temperature and thus improve the draw of the insert and reduce creosote formations within the flue pipe.

While direct connection systems provide the best and safest installation of an insert into a masonry fireplace, they are relatively expensive since preferably the flue piping is constructed of stainless steel, and, in the past, each installation had to be substantially custom fitted. Even the system disclosed in the cited patent which only provides for positive connection and not direct connection, is for all practical purposes a customized installation due to the complex nature of the interconnection devices and the installation difficulties which are apparent from a review of the patent.

In an attempt to hold down insert installation costs, one of the less than satisfactory arrangements, i.e., simply placing the insert into a fireplace or providing positive connection, have normally been utilized. Even when a direct connection system has been installed, oftentimes the interconnecting flue pipes have been made of an inferior grade of stainless steel which helps hold down costs, but results in a reduced life expectancy for the flue system of the insert. For example, 304 stainless, which is subject to acid damage, may be used for reduced cost and provide an approximate five year lifetime while 316 stainless, which is more expense and resistant to acid damage, would provide a preferred lifetime of approximately 15 to 25 years. Further, 304 stainless tends to deflect at temperatures produced during a chimney fire while 316 stainless does not.

Customizing is required in direct connection systems for interconnecting a wood stove insert to a flue pipe inserted into the flue liner of a fireplace chimney since inserts vary from maker to maker and masonry fireplaces are customized and hand built resulting in widely varying internal dimensions. This results in substantial variations in the horizontal distances between the flue outlet of a fireplace insert and the flue pipe inserted within the flue liner of a fireplace chimney.

Accordingly, there is a need for a flue fitting which can be adjustably adapted to accommodate varying horizontal distances between insert flue outlets and flue pipes to which they are to be connected to substantially reduce the amount of time and effort required in properly installing a direct connection system. Such an adjustable fitting will permit manufacture in large quantities prior to installation since the fitting can be readily adjusted on site to accommodate a large variety of inserts and fireplaces thus avoiding customized installation. By manufacturing the adjustable fittings in large quantities, not only can the cost be reduced, but also the fittings can be constructed from higher quality stainless steel, such as 316 stainless steel, which will last longer and provide more durability than many customized systems which frequently are constructed from cheaper 304 stainless steel to provide reduced cost installation.

SUMMARY OF THE INVENTION

The problems of the prior art wherein customized or essentially customized installation is required for direct connection systems for fireplace inserts have been overcome in accordance with the adjustable flue fitting of the present invention. The adjustable fitting can be telescopically expanded or contracted to accommodate varying horizontal distances between a flue outlet of an insert to be installed and a flue pipe inserted within a chimney flue liner of a masonry fireplace which is to receive the insert. Since the adjustable fitting of the present invention can be readily adapted on site to accommodate a large variety of inserts and fireplaces, a single size fitting can be produced in large quantities at correspondingly reduced costs. Quantity production also permits the fitting to be constructed from a superior grade of stainless steel to increase the lifetime and durability of the system and still result in lower installation charges because of reduced labor costs since less time is required for a standard installation than for a customized installation.

In accordance with one aspect of the present invention, an adjustable fitting for connecting a wood burning insert for a masonry fireplace to a vent pipe positioned within the flue liner of the fireplace chimney comprises an insert connector having first and second legs which are substantially perpendicular to one another. The first leg of the insert connector is vertically oriented when the fitting is in use and is sized to engage a flue gas outlet of the wood burning insert. A vent pipe connector completes the adjustable fitting and has first and second legs which are substantially perpendicular to one another. The first leg of the vent pipe connector is vertically oriented when the fitting is in use and is sized to engage a lowermost end of the vent pipe. The second legs of the insert connector and the vent pipe connector are formed such that they can be telescopically interfitted to one another to adjust the spacing between the first legs of the connectors to thereby adapt the fitting to a large variety of inserts and fireplaces.

Preferably the second leg of the vent pipe connector telescopically interfits into the second leg of the insert connector and the second legs of the connectors are substantially rectangular in cross section. For efficient operation and to extend the life of the adjustable fitting of the present invention, the connectors forming the fitting are preferably made of 26 gauge 316 stainless steel which should provide a lifetime of approximately 15 years in normal usage.

In accordance with another aspect of the present invention, an adjustable fitting for connecting a wood burning insert for a masonry fireplace to a vent pipe positioned within the flue liner of the fireplace chimney comprises a generally z-shaped tubular member having an upper bar, a lower bar and an interconnecting bar therebetween. The z-shaped tubular member is positioned on its side when in use with the upper bar of the z-shape member pointing vertically downward and being sized to engage a flue gas outlet of the insert, the lower bar of the z-shaped member pointing vertically upward and being sized to engage a lower end of the vent pipe and the interconnecting bar of the z-shaped member being telescopically extendable to adjust the horizontal distance between the upper and lower bars to adapt the fitting to a large variety of inserts and fireplaces.

It is therefore an object of the present invention to provide an adjustable fitting for direct connection of a wood burning insert for a masonry fireplace to a vent pipe positioned in the flue liner of the fireplace chimney wherein the horizontal distance between a portion of the fitting engaging the flue outlet of the insert and the portion of the fitting engaging the vent pipe in the flue liner can be telescopically adjusted to permit the fitting to be used for installing a large variety of inserts into a large variety of fireplaces.

Other objects and advantages of the invention will be apparent from the following description, the accompanying drawings and the appended claims.

DETAILED DESCRIPTION OF THE INVENTION

Figure 1:
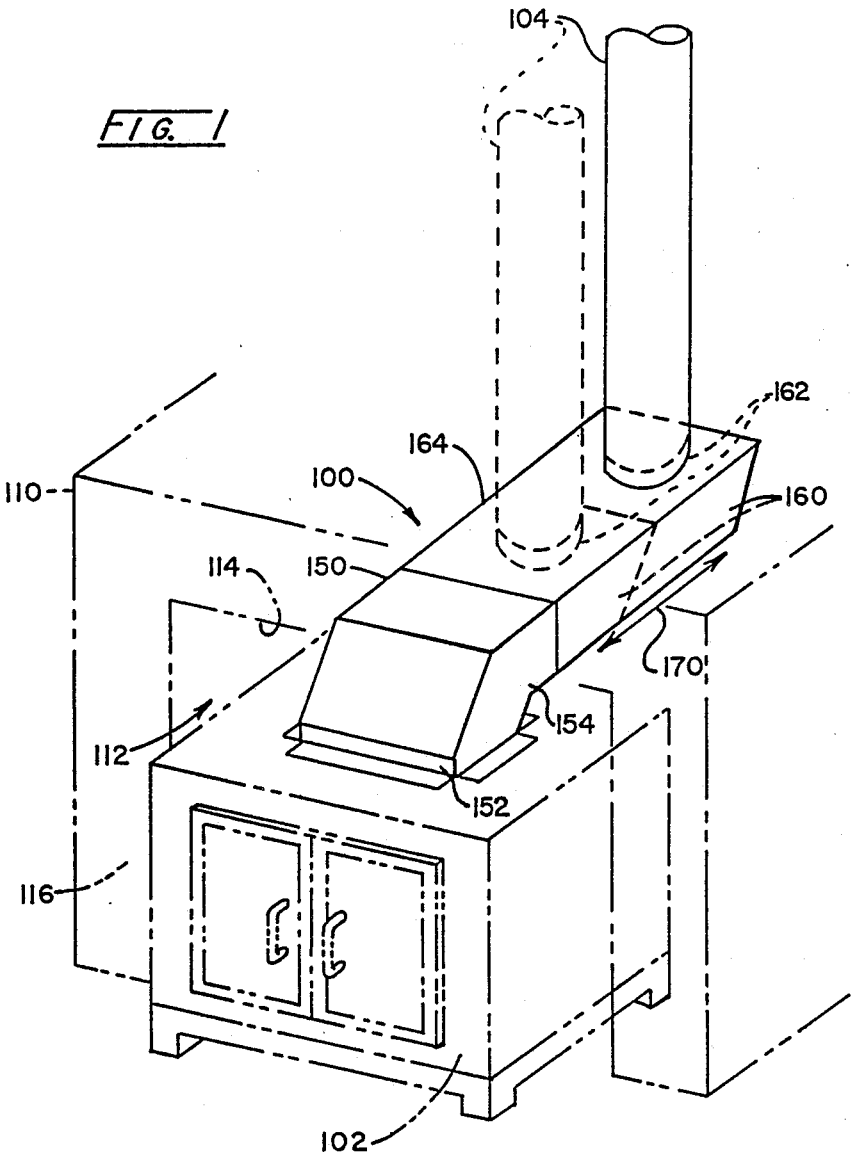
FIG. 1 is a perspective schematic view of a fireplace insert connected to a flue pipe inserted within the flue liner (not shown) by means of an adjustable fitting in accordance with the present invention.
Figure 2:
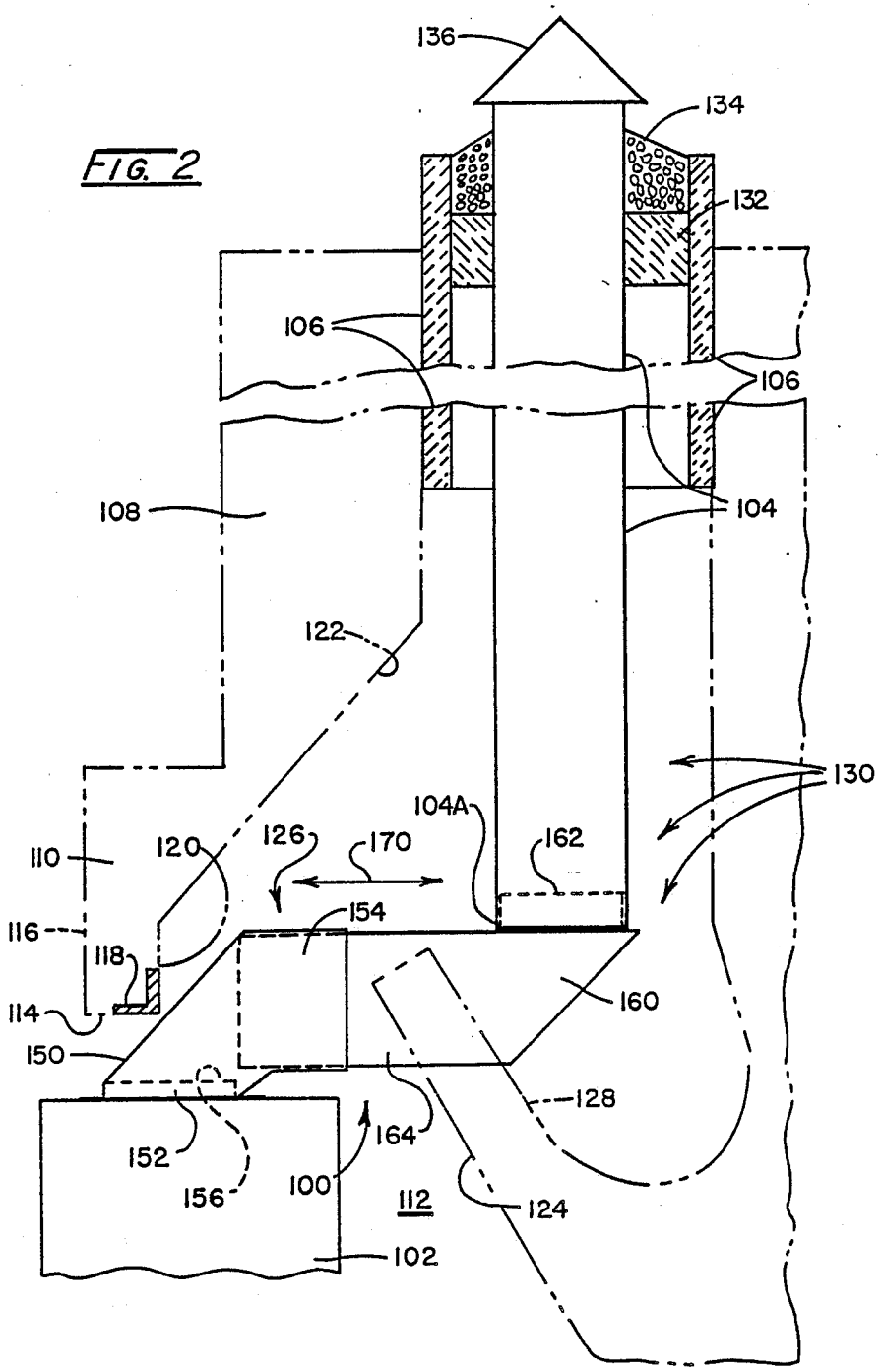
FIG. 2 is a sectional view taken along a vertical plane extending generally through the center of the fireplace insert and flue pipe of FIG. 1.

A direct connection system incorporating an adjustable fitting 100 in accordance with the present invention is shown in FIGS. 1 and 2. The adjustable fitting 100 connects between a fireplace insert 102 and a vent pipe 104 positioned within a flue liner 106 of a chimney 108 of a masonry fireplace 110. The fireplace 110 has a firebox recess 112 surrounded by an opening 114 which extends through a facing 116. A lintel 118, such as an angle iron depicted in FIG. 2, spans the opening 114 and supports that portion of the facing 116 positioned above the opening 114. The firebox recess 112 is partially bounded by a front wall 120 on the interior thereof that extends vertically upwardly from the lintel 118 and then extends rearwardly and upwardly to define a corbel 122 generally up to the flue liner 106 of the chimney 108.

The opposing rear wall 124 of the interior of the firebox recess 112 converges upwardly and forwardly toward the front wall 120 to define a throat 126 across which a damper frame is normally operatively positioned for the fireplace. The damper frame is not shown because it has been removed for installation of the insert 102. The rear wall 124 defines as a smoke shelf 128 and smoke chamber 130 within the fireplace 110.

The vent pipe 104, which is appropriately sized for the insert 102 and generally ranges in size from approximately 5–8 inches, is inserted through the flue liner 106 of the chimney 108 to thereby reduce the substantial surface area within the smoke chamber 130 and the air flow capacity of the flue liner 106. The flue pipe 104 is positively connected to the insert by means of the fitting 100 of the present invention as will become apparent and is also preferably sealed at the top of the chimney 108 by means of insulation 132 and possibly masonry fill 134 or otherwise with the vent pipe 104 preferably being topped off by a flue cap 136. By sealing the vent pipe 104 at the top of the chimney 108, any heated air which is withdrawn from the inside of the house containing the fireplace 110 as well as any heat transferred through the vent pipe 104 will be trapped within the flue liner 106 of the chimney 108 and tend to increase the stack temperature and thus improve the draw of the insert 102 and also reduce creosote formations within the vent pipe 104.

The fireplace 110 is prepared for installation of the insert 102 by means of the adjustable fitting 100 by initially removing the damper system including a metal damper frame piece which is secured to the rear wall 124 within the firebox recess 112. Also, a central portion of the rear wall 124 is removed to form an opening to receive the fitting 100. The removed central portion usually comprises one or two of the bricks or blocks normally forming the rear wall 124. The smoke chamber 130 may also be modified if necessary but normally this is not required when the adjustable fitting 100 is utilized to install the insert 102.

Figure 3:
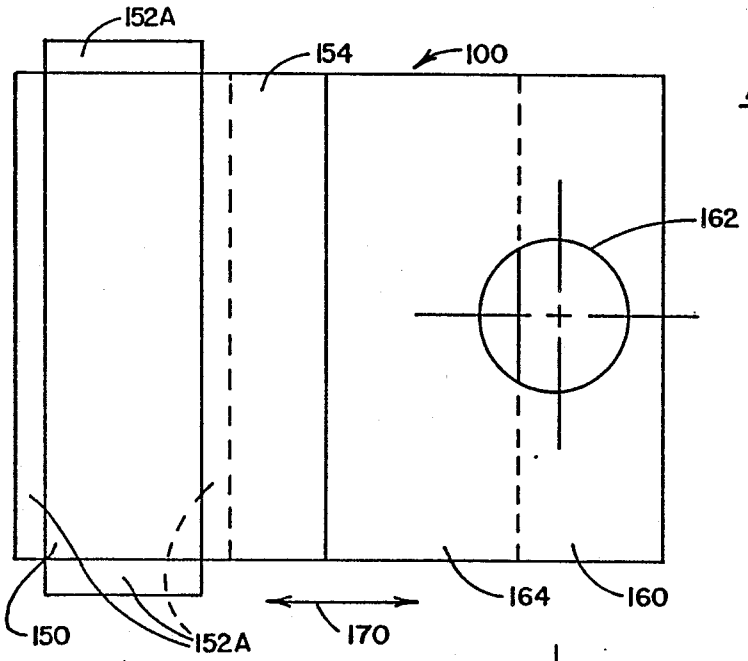
FIGS. 3–5 are a top plan view, a side view, and an end view of the adjustable fitting of the present invention.
Figure 4:
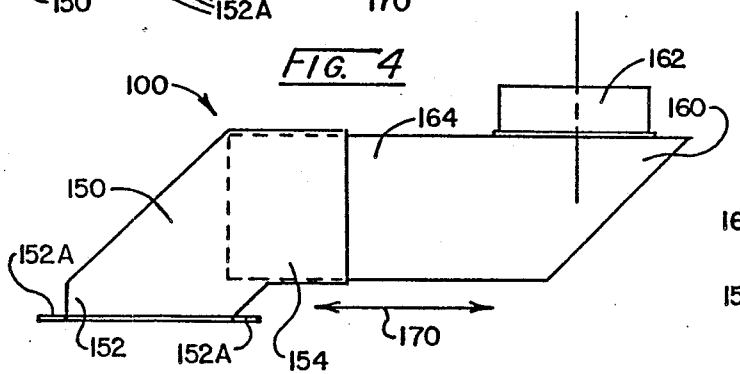
Figure 5:
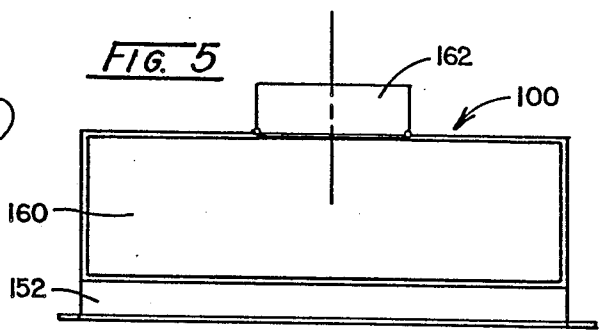

The adjustable fitting 100 in accordance with the present invention as best shown in FIGS. 3–5 comprises an insert connector 150 having a first leg 152 and a second leg 154 which are substantially perpendicular to one another. As shown in FIGS. 1 and 2, the first leg 152 of the insert connector 150 is vertically oriented when the fitting is in use and is sized to engage a flue gas outlet 156 of the wood burning insert 102.

The second portion of the adjustable fitting 100 comprises a vent pipe connector 160 which has a first leg 162 and a second leg 164, the first and second legs 162 and 164 also being substantially perpendicular to one another. The first leg 162 of the vent pipe connector 160 is also vertically oriented when the adjustable fitting 100 is in use and is sized to engage the lowermost end 104A of the vent pipe 104, see FIG. 2. The second leg 154 of the insert connector 150 and the second leg 164 of the vent pipe connector 160 are formed such that they can be telescopically interfitted to one another to adjust the spacing between the first legs 152 and 162 of the connectors 150 and 160 to thereby adapt the fitting 100 to a large variety of inserts and fireplaces.

Preferably, the second leg 164 of the vent pipe connector 160 telescopically interfits into the second leg 154 of the insert connector 150 and the second legs 154 and 164 of the connectors 150 and 160 are substantially rectangular in cross section. It is noted, however, that alternate geometric cross sections are possible for the second legs 154 and 164 of the connectors 150 and 160 of the present invention.

For efficient operation and to extend the life of the adjustable fitting 100 of the present invention, the connectors 150 and 160 are preferably formed from 26 gauge 316 stainless steel which should provide a lifetime of approximately 15 years in normal usage and up to 25 years with proper maintenance. The use of 316 stainless steel also provides more durability since it can tolerate temperatures of around 3400° F. without deterioration and deflection. Hence, 316 stainless steel can tolerate chimney fire temperatures, which commonly range from 1700° F. to 2500° F., while lesser grades of stainless steel cannot. Since the adjustable fitting 100 is preferably formed from stainless steel sheeting, flanges 152A are preferably formed around the perimeter of the first leg 152 of the insert connector 150 to facilitate sealed connection of the adjustable fitting 100 with the flue gas outlet 156 of the wood burning insert 102.

As shown in FIG. 1 by the solid line and dashed line drawings of the vent pipe 104 and the vent pipe connector 160, the adjustable fitting 100 of the present invention can accommodate a substantial variation in the horizontal distance between the flue gas outlet 156 of the insert 102 and the vent pipe 104 to permit the fitting 100 to be used for installing a large variety of inserts into a large variety of fireplaces.

The second legs 154 and 164 of the connectors 150 and 160 may be telescopically expanded or contracted as indicated by an arrow 170 to accommodate the varying horizontal distances between the flue outlet of an insert to be installed and a flue pipe inserted within the chimney flue liner of a masonry fireplace which is to receive the insert.

A review of FIGS. 3–5 will show that the adjustable fitting 100 should be constructed such that the second leg 164 of the vent connector 160 is sized to sufficiently overlap the second leg 154 of the flue connector 150 when the first legs 152 and 162 are horizontally separated relative to one another at a maximum anticipated distance for any insert and any fireplace. For shorter horizontal distances between the first legs 152 and 162, the second leg 164 of the vent pipe connector 160 can be telescopically inserted into the second leg 154 of the insert connector 150 to reduce the horizontal distance. If a still shorter horizontal distance is required between the first legs 152 and 162, the second leg 164 of the vent pipe connector 160 is cut to reduce its length.

The adjustable fitting 100 of the present invention can be viewed as a generally z-shaped tubular member having an upper bar 152, a lower bar 162 and an interconnecting bar 154, 164 extending therebetween. If so envisioned, the interconnecting bar of the z-shaped member is telescopically extendable to adjust the horizontal distance between the upper and lower bars to adapt the fitting to a large variety of inserts and fireplaces.

Having described the invention in detail and by reference to preferred embodiments thereof, it will be apparent that modifications and variations are possible without departing from the scope of the invention defined in the appended claims.

What is claimed is:

1. A horizontally adjustable fitting for connecting a wood burning insert for a masonry fireplace to a vent pipe positioned within the flue liner of the fireplace chimney, said masonry fireplace having a firebox recess including a rear wall which converges upwardly and forwardly toward a front wall, said horizontally adjustable fitting extending through a central portion of said rear wall and comprising;

an insert connector having first and second legs which are substantially perpendicular to one another, said first leg being vertically oriented when said horizontally adjustable fitting is in use and sized to engage a flue gas outlet of said wood burning insert; and a vent pipe connector having first and second legs which are substantially perpendicular to one another, said first leg being vertically oriented when said horizontally adjustable fitting is in use and sized to engage a lowermost end of said vent pipe, the second legs of said insert connector and said vent pipe connector being formed such that they can be telescopically interfitted to one another to adjust the spacing between the first legs of said connectors to adapt said horizontally adjustable fitting to a large variety of inserts and fireplaces.

2. A horizontally adjustable fitting for connecting a wood burning insert for a masonry fireplace to a vent pipe positioned within the flue liner of the fireplace as claimed in claim 1 wherein the second leg of said vent pipe connector telescopically interfits into the second leg of said insert connector.

3. A horizontally adjustable fitting for connecting a wood burning insert for a masonry fireplace to a vent pipe positioned within the flue liner of the fireplace as claimed in claim 2 wherein the second legs of said connectors are substantially rectangular in cross section.

4. A horizontally adjustable fitting for connecting a wood burning insert for a masonry fireplace to a vent pipe positioned within the flue liner of the fireplace chimney as claimed in claim 3 wherein said connectors are made of 26 gauge 316 stainless steel.

5. A horizontally adjustable fitting for connecting a wood burning insert for a masonry fireplace to a vent pipe positioned within the flue liner of the fireplace chimney, said masonry fireplace having a firebox recess including a rear wall which converges upwardly and forwardly toward a front wall, said horizontally adjustable fitting extending through a central portion of said rear wall and comprising; a generally z-shaped tubular member having an upper bar, a lower bar and an interconnecting bar therebetween and being positioned on its side when in use, the upper bar of said z-shaped member pointing vertically downward and being sized to engage a flue gas outlet of said insert, the lower bar of said z-shaped member pointing vertically upward and being sized to engage a lower end of said vent pipe, and the interconnecting bar of said z-shaped member being telescopically extendable to adjust the horizontal distance between said upper and lower bars to adapt said horizontally adjustable fitting to a large variety of inserts and fireplaces.

6. A horizontally adjustable fitting for connecting a wood burning insert for a masonry fireplace to a vent pipe positioned within the flue liner of the fireplace chimney as claimed in claim 5 wherein the interconnecting bar of said z-shaped member is substantially rectangular in cross section.

7. A horizontally adjustable fitting for connecting a wood burning insert for a masonry fireplace to a vent pipe positioned within the flue liner of the fireplace chimney as claimed in claim 6 wherein said fitting is made of 26 gauge 316 stainless steel.

* * * * *